US012668968B2

(12) United States Patent
McSparrin

(10) Patent No.: US 12,668,968 B2
(45) Date of Patent: Jun. 30, 2026

(54) CONSTRUCTION TIE FOR SECURING U-CHANNELS VERTICALLY IN COLUMNS

(71) Applicant: MDM Enterprises, Inc., Edmond, OK (US)

(72) Inventor: Michael D. McSparrin, Stillwater, OK (US)

( * ) Notice: Subject to any disclaimer, the term of this patent is extended or adjusted under 35 U.S.C. 154(b) by 463 days.

(21) Appl. No.: 18/165,511

(22) Filed: Feb. 7, 2023

(65) Prior Publication Data

US 2023/0257990 A1 Aug. 17, 2023

Related U.S. Application Data

(60) Provisional application No. 63/343,907, filed on May 19, 2022, provisional application No. 63/309,957, filed on Feb. 14, 2022.

(51) Int. Cl.

| | |
|---|---|
| ***E04B 1/41*** | (2006.01) |
| ***E04B 1/58*** | (2006.01) |
| *E04B 2/60* | (2006.01) |

(52) U.S. Cl.

CPC ..... *E04B 1/4107* (2013.01); *E04B 1/4178* (2013.01); *E04B 1/5818* (2013.01); *E04B 2/60* (2013.01)

(58) Field of Classification Search

CPC .... E04B 1/4107; E04B 1/4178; E04B 1/5818; E04B 2/60; E04B 1/2403; E04B 1/2608; E04B 1/2612; E04B 1/62; E04B 1/94; E04B 1/943; E04B 2001/2415; E04B 2/56; E04B 2/723; E04B 2/7403; E04B 2002/728

USPC ..... 52/704, 378, 379, 506.5, 513, 562, 565, 52/702, 712, 713, 714, 715, 92.2, 92.3

See application file for complete search history.

(56) References Cited

U.S. PATENT DOCUMENTS

| | | | | |
|---|---|---|---|---|
| 517,186 A | | 3/1894 | Goetz | |
| 725,526 A | | 4/1903 | Whitehurst | |
| 796,248 A | | 8/1905 | Rieseck | |
| 941,617 A | * | 11/1909 | Chapman | E04D 11/02 52/712 |

(Continued)

FOREIGN PATENT DOCUMENTS

| | | | | |
|---|---|---|---|---|
| GB | 2289906 B | | 12/1995 | |
| GB | 2424660 A | * | 10/2006 | E04B 1/4178 |

(Continued)

*Primary Examiner* — Brian D Mattei
*Assistant Examiner* — Joseph J. Sadlon
(74) *Attorney, Agent, or Firm* — Mary M. Lee

(57) ABSTRACT

A construction tie for securing vertical U-channels of a motorized retractable screen unit to surrounding building material, such as brick, stone, or stucco. The tie includes a U-shaped clip that closely conforms to the shape of the U-channel. One or more flanges extend laterally from the clip to overlie the adjacent bricks. A plurality of these ties may be spaced vertically along the length of the U-channel. Once the brick façade is complete, the ties are not visible. Making the ties out of magnetically detectable material allows for locating their positions. The number of flanges may vary; one may extend from each side of the clip, or a single flange may extend rearwardly from the back of the base. A method of installing a screen unit may include the use of the inventive construction ties. A kit for installing the screen unit may include a plurality of the ties.

22 Claims, 6 Drawing Sheets

(56) References Cited

U.S. PATENT DOCUMENTS 1,275,037 A * 8/1918 Jacobus ..... F27D 1/004 110/336
2,141,397 A * 12/1938 Locke ..... E04B 2/42 52/564
2,150,798 A * 3/1939 Crandall ..... E04F 13/0801 52/714
2,213,355 A 9/1940 Woodworth
2,214,388 A * 9/1940 Summers ..... B65D 63/04 180/68.5
2,225,574 A * 12/1940 Thompson ..... E04C 3/07 52/364
2,325,653 A * 8/1943 Bingham ..... E04B 1/62 52/603
2,345,650 A * 4/1944 Attwood ..... E06B 3/9687 411/105
2,611,160 A * 9/1952 Hanesse ..... A63H 33/107 182/228.1
2,669,861 A * 2/1954 Clutter ..... E04B 2/30 52/444
2,737,268 A * 3/1956 Smith ..... E04G 5/00 248/245
2,747,904 A * 5/1956 Koch ..... A47G 1/1633 403/375
2,791,117 A * 5/1957 Bailey ..... E04B 1/644 52/410
2,949,763 A 8/1960 Felder
3,114,220 A * 12/1963 Maddox ..... F27D 1/14 52/444
3,559,357 A * 2/1971 Lowe ..... E04B 1/18 52/656.1
3,615,110 A * 10/1971 Fugate ..... F16B 7/00 403/230
3,628,299 A * 12/1971 Nakazawa ..... E04B 1/4107 52/506.06
3,638,803 A * 2/1972 MacMillan ..... A47B 47/0008 108/159
3,685,230 A * 8/1972 Lickliter ..... E04B 2/60 52/677
3,685,863 A * 8/1972 Oetiker ..... E04B 1/2403 52/645
3,782,058 A * 1/1974 Allen ..... E04B 1/41 52/712
3,986,314 A * 10/1976 Moeller ..... E04B 9/006 D25/138
4,034,529 A * 7/1977 Lampus ..... E04B 1/4185 52/690
4,263,952 A * 4/1981 Kowalski ..... F16B 37/046 411/116
4,329,825 A * 5/1982 Zehtner ..... E04G 21/125 52/704
4,399,855 A * 8/1983 Volfson ..... E06B 9/11 160/271
4,568,050 A * 2/1986 Radoy ..... A47B 57/565 211/187
4,572,695 A * 2/1986 Gilb ..... F16B 9/058 403/14
4,738,070 A * 4/1988 Abbott ..... E04F 13/0821 52/713
4,843,779 A 7/1989 Whitney Jr.
4,895,331 A * 1/1990 Nehls ..... A47B 57/565 248/245
4,912,900 A * 4/1990 Yeamans ..... E04D 13/1415 52/287.1
4,948,313 A * 8/1990 Zankovich ..... F16B 37/045 411/85
5,007,222 A * 4/1991 Raymond ..... F24F 13/20 52/775
5,033,901 A * 7/1991 Dias ..... E04B 1/1912 403/403
5,038,535 A * 8/1991 Van Praag, III ..... E04B 2/74 403/DIG. 1
5,186,571 A * 2/1993 Hentzschel ..... E04H 17/1413 403/231
5,188,479 A * 2/1993 Nehls ..... F16B 19/1081 403/306
5,259,685 A * 11/1993 Gilb ..... E04B 1/26 403/231
5,481,844 A * 1/1996 Kajita ..... E04B 1/26 52/745.12
5,568,862 A * 10/1996 Black, Jr. ..... B65D 71/02 206/338
5,598,673 A * 2/1997 Atkins ..... E04B 1/7612 52/302.1
5,611,183 A * 3/1997 Kim ..... E04B 2/8641 52/363
5,816,008 A 10/1998 Hohmann
5,860,262 A * 1/1999 Johnson ..... E04B 1/14 52/294
6,119,430 A * 9/2000 Nicholls ..... E02D 29/02 52/118
6,176,059 B1 * 1/2001 Cantarano ..... E04B 1/6179 52/592.1
6,182,415 B1 * 2/2001 O'Berry ..... E04F 15/00 52/514
6,295,781 B1 10/2001 Thompson
6,364,303 B1 * 4/2002 Gustavson ..... E04F 21/185 269/37
6,694,700 B1 * 2/2004 Mackett ..... E04B 1/0046 411/404
6,964,136 B2 * 11/2005 Collins ..... E04B 1/70 52/302.1
6,964,137 B2 * 11/2005 Frascari ..... E04F 13/0819 52/390
7,171,788 B2 2/2007 Bronner
7,234,566 B2 * 6/2007 Simmons ..... E04B 1/4107 52/301
7,398,620 B1 * 7/2008 Jones ..... E04B 7/045 52/93.2
7,559,519 B1 * 7/2009 Dragic ..... E04B 2/7457 52/712
7,594,331 B2 * 9/2009 Andrews ..... E04B 2/766 29/897.3
8,061,088 B2 * 11/2011 Walker ..... E04B 7/045 52/696
8,118,925 B2 * 2/2012 Rodriguez ..... C04B 35/6263 106/644
8,511,041 B2 * 8/2013 Fransen ..... E04G 21/1816 33/645
8,555,587 B2 * 10/2013 Hohmann, Jr. ..... E04G 23/0222 52/391
8,631,626 B2 * 1/2014 Ballantine ..... E04B 1/2604 52/715
8,713,872 B2 * 5/2014 Rempel ..... E04B 1/2608 52/573.1
8,881,488 B2 * 11/2014 Hohmann, Jr. ..... E04B 1/046 52/379
8,904,731 B2 12/2014 Hohmann, Jr. et al.
8,955,285 B2 * 2/2015 Fournier ..... E04B 2/88 52/509
8,979,047 B2 * 3/2015 Coyle ..... E06B 1/36 248/220.21
9,328,852 B2 * 5/2016 Satterwhite ..... F16L 5/00
9,347,213 B1 * 5/2016 Zhang ..... E04B 1/388
9,458,626 B2 10/2016 Hohmann, Jr. et al.
10,156,079 B2 * 12/2018 Kennelly ..... E04B 1/185
10,202,755 B2 * 2/2019 Montminy ..... E04B 2/30
D845,116 S * 4/2019 Wokutch ..... D8/380
10,400,445 B2 * 9/2019 Battaglia ..... E04B 1/84
10,480,197 B2 * 11/2019 Hohmann, Jr. ..... E04F 13/0857
10,619,343 B2 * 4/2020 Heady ..... B21D 35/001
10,858,819 B2 * 12/2020 Styrc ..... E04B 1/0046
11,118,358 B2 * 9/2021 Hatzinikolas ..... E04F 13/0857
11,401,709 B2 * 8/2022 Stauffer ..... E04B 1/4178
11,560,709 B2 * 1/2023 Hatzinikolas ..... E04B 2/06
12,234,852 B2 * 2/2025 De Frene ..... E04F 13/0805
12,338,070 B2 * 6/2025 Austrheim ..... B65G 1/02
2003/0145537 A1 * 8/2003 Bailey ..... E04B 2/767 52/481.1

(56) References Cited

U.S. PATENT DOCUMENTS

| | | | | |
|---|---|---|---|---|
| 2008/0098681 | A1* | 5/2008 | Hatzinikolas | E04B 1/4178 52/378 |
| 2009/0205282 | A1* | 8/2009 | Belsley | E04B 2/7453 52/565 |
| 2010/0058700 | A1* | 3/2010 | LeBlang | E04B 1/80 249/19 |
| 2010/0325998 | A1* | 12/2010 | Clear | E04B 2/24 52/562 |
| 2012/0233950 | A1* | 9/2012 | Carr | E04C 5/20 52/686 |
| 2015/0096243 | A1* | 4/2015 | Hohmann, Jr. | E04B 1/4178 52/309.1 |

FOREIGN PATENT DOCUMENTS

| | | | | |
|---|---|---|---|---|
| GB | 2424660 | B | 10/2006 | |
| KR | 2006015766 | A * | 2/2006 | E04B 4/4114 |
| KR | 101680738 | B1 | 5/2016 | |
| WO | WO-2006074361 | A2 * | 7/2006 | E04B 1/4178 |

* cited by examiner

CONSTRUCTION TIE FOR SECURING U-CHANNELS VERTICALLY IN COLUMNS

CROSS-REFERENCE TO RELATED APPLICATIONS

This application claims the benefit of U.S. provisional application No. 63/343,907, entitled "Improved Construction Tie for Securing U-Channels Vertically in Columns," filed May 19, 2022, and U.S. provisional application No. 63/309,957, entitled "Improved Construction Tie for Securing U-Channels Vertically in Columns," filed Feb. 14, 2022, the contents of which are incorporated herein by reference.

FIELD OF THE INVENTION

The present invention relates to construction ties for use in securing the U-channels for motorized retractable screens to the façade building material used to cover support columns.

BRIEF DESCRIPTION OF THE DRAWINGS

The accompanying drawings, which are incorporated into and form a part of the specification, illustrate one or more embodiments of the present invention and, together with this description, serve to explain the principles of the invention. The drawings merely illustrate a preferred embodiment of the invention and are not to be construed as limiting the scope of the invention.

DETAILED DESCRIPTION OF THE PREFERRED EMBODIMENT(S)

Figure 1:
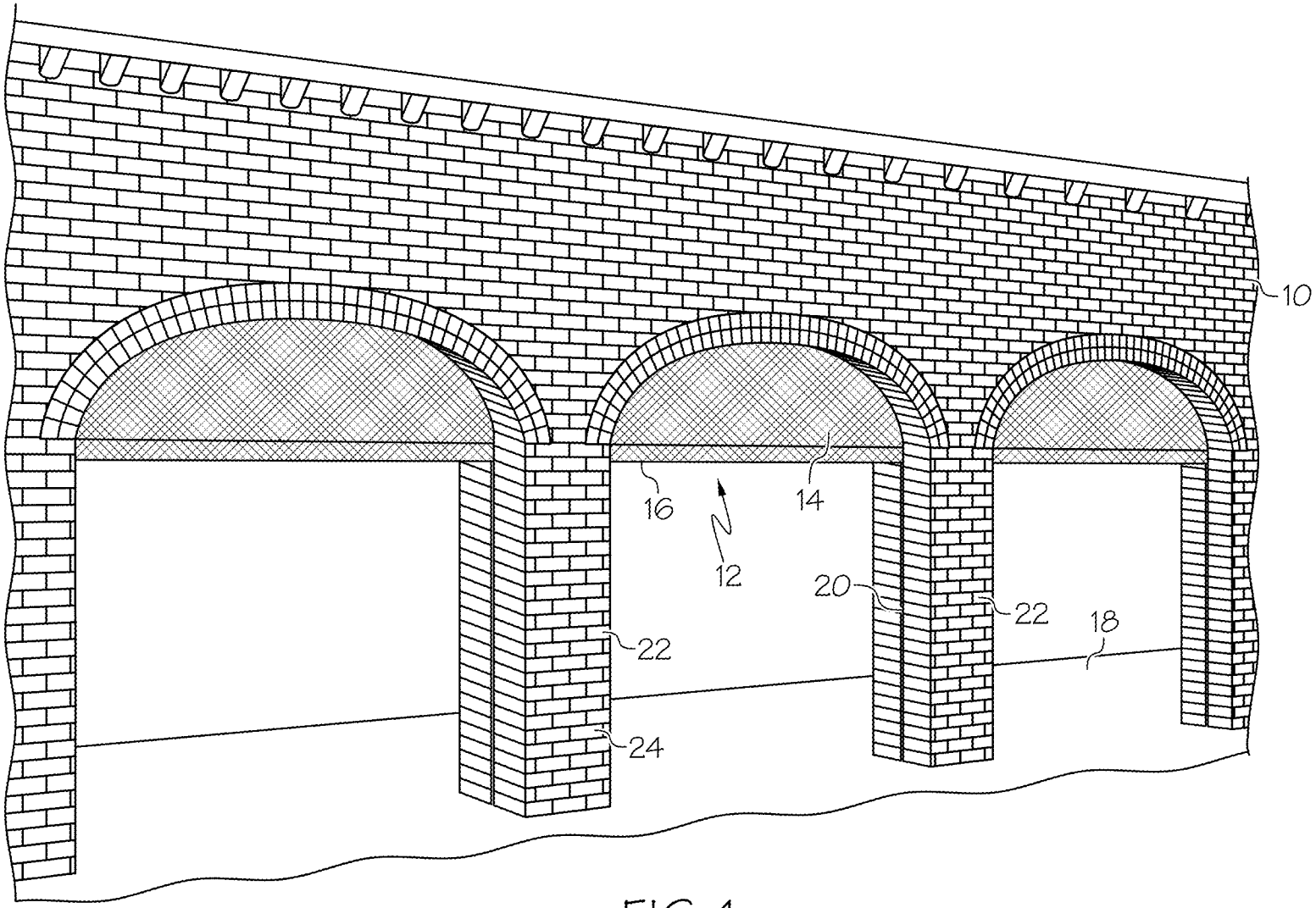
FIG. 1 is a perspective view of building having three large openings with built-in motorized screens. The side edges of the screen move up and down inside U-channel installed in the wall or intervening columns overlayed with brick or other façade material.

Built-in motorized retractable screens for patios and lanais are becoming increasingly popular in both residential and commercial buildings. FIG. 1 illustrates the wall 10 of a structure with three such screen units, designated collectively at 12. Each of these retractable screens 12 includes a large panel 14 that is stored on a roll (not shown) mounted on or near the ceiling. The screen panel 14 is deployed by lowering the leading edge 16 downwardly until it meets the floor 18 or threshold. The side edges of the screen panel 14 move up and down inside vertical U-channels 20 mounted in vertical columns 22 on each side of the opening spanned by the screen. These columns 22 are usually covered with a decorative façade 24 of brick, rock, or stucco. A system for facilitating the installation of these screens is shown and described in U.S. Pat. No. 10,017,983 issued Jul. 10, 2018, and U.S. Pat. No. 10,190,365, issued Jan. 29, 2019, both entitled "Header Assembly and Method for installing Retractable Screens," and the contents of these patents are incorporated herein by reference.

Figure 2:
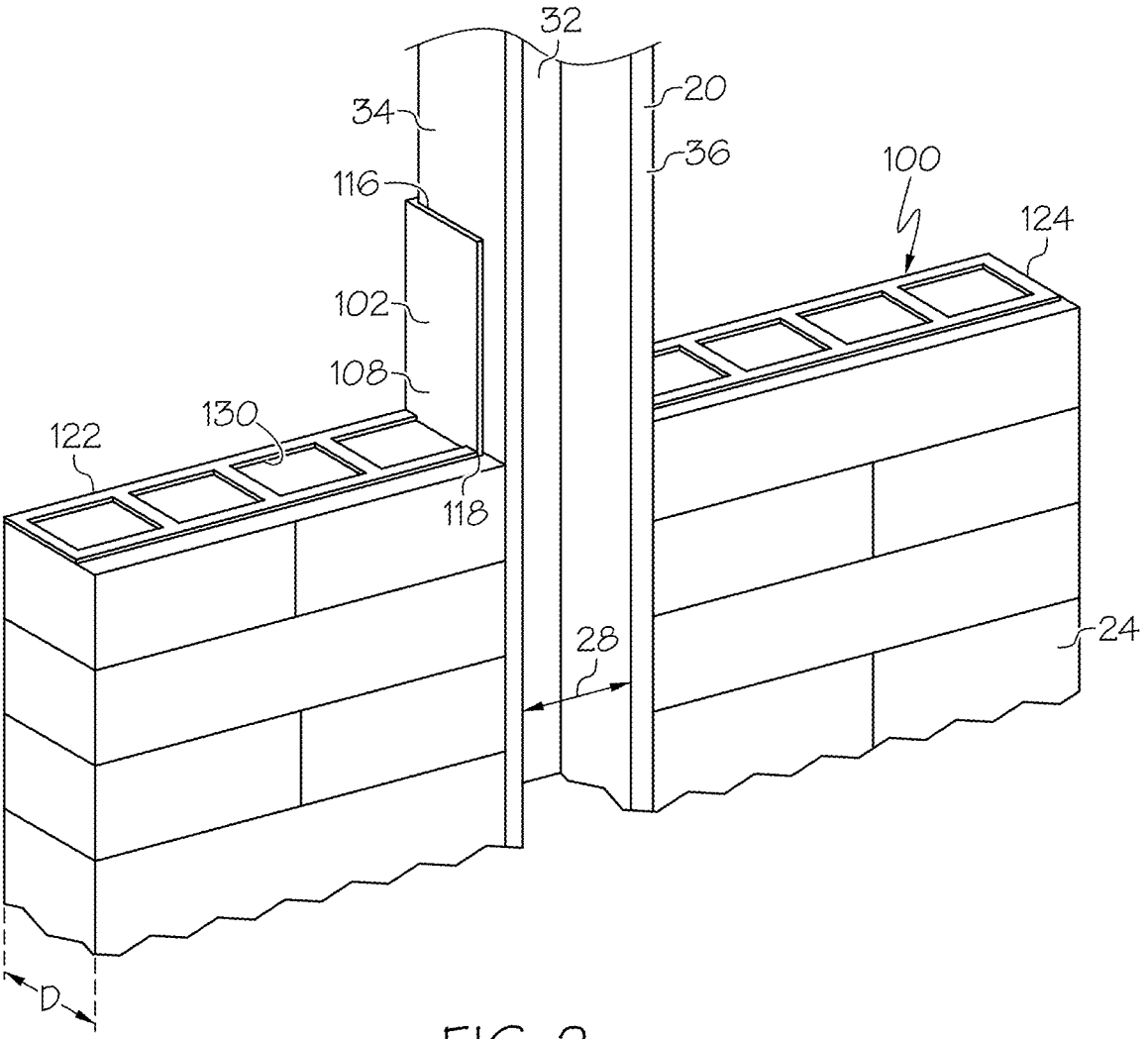
FIG. 2 is a front perspective fragmented view of a partially completed column showing the U-channel and illustrating the use of the inventive construction tie.
Figure 3:
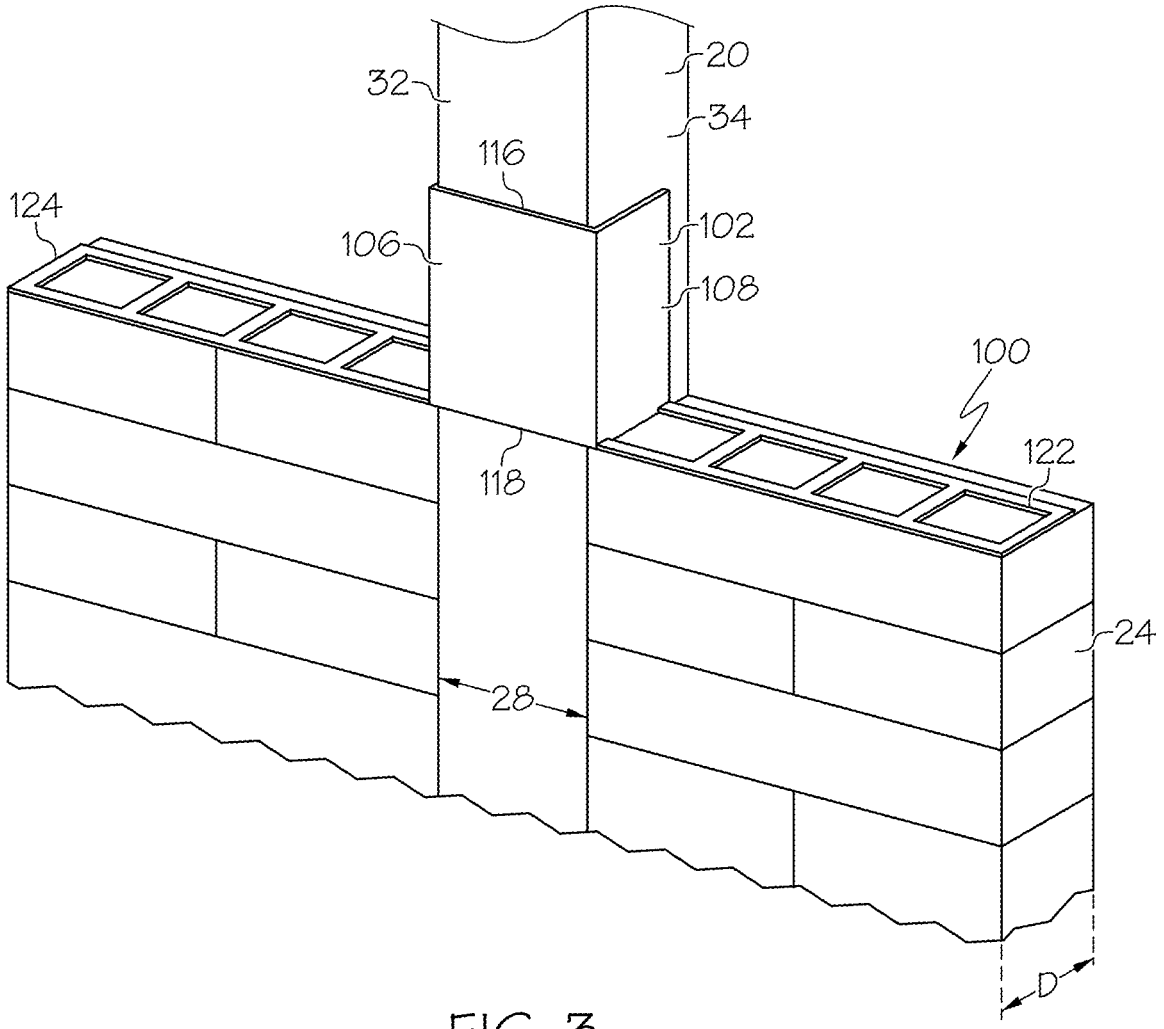
FIG. 3 is a back perspective view of the partially completed column shown in FIG. 2.

As shown in FIGS. 1-3, in a typical installation, the screen's U-channels 20 are secured in position, and the brick façade 24 or other surface treatment is applied around the vertical channels. Thus, the brick 24 or other façade material does not wrap continuously around the column 22. Instead, there a long, vertical space 28 (FIGS. 2&3) between vertical borders of the façade 24 that abut the sides of the U-channel 20. This can result in a loss of stability.

The present invention provides a construction tie specially designed to secure the façade material 24 to the screen's vertical U-channels 20 to hold the column 22 together firmly. The inventive tie is inexpensive to manufacture and simple to install. These and other advantages will be apparent from the following description of illustrative non-limiting embodiments.

Turning now to FIGS. 2-6 in particular, there is shown therein a construction tie made in accordance with an embodiment of the present invention and designated generally by the reference number 100. The tie 100 is adapted for securing the U-channel 20 of a motorized, retractable screen 12 to a façade material 24, such as the decorative brick covering the support columns 22 (FIGS. 1-3) in which the U-channels are positioned. As used herein, "façade" is used broadly to denote any type of construction material used to cover the columns, wall, or other structures supporting the U-channels. By way of example, "façade" material may a material supplied in units, such as bricks or rocks.

As seen in FIGS. 2 and 3, the typical U-channel 20 is U-shaped in cross-section comprising a back 32 and first and second sides 34 and 36, respectively. As is also shown in FIGS. 2 and 3, the façade material 24 has a depth "D" (FIG. 3) In most instances, the installed façade material 24 comprises a plurality of units, such as rocks or bricks, that are applied with an appropriate mortar material (not shown). As used herein, "mortar" is used broadly and includes any of various materials or compounds for bonding together bricks, stones, or other façade material.

Figure 4:
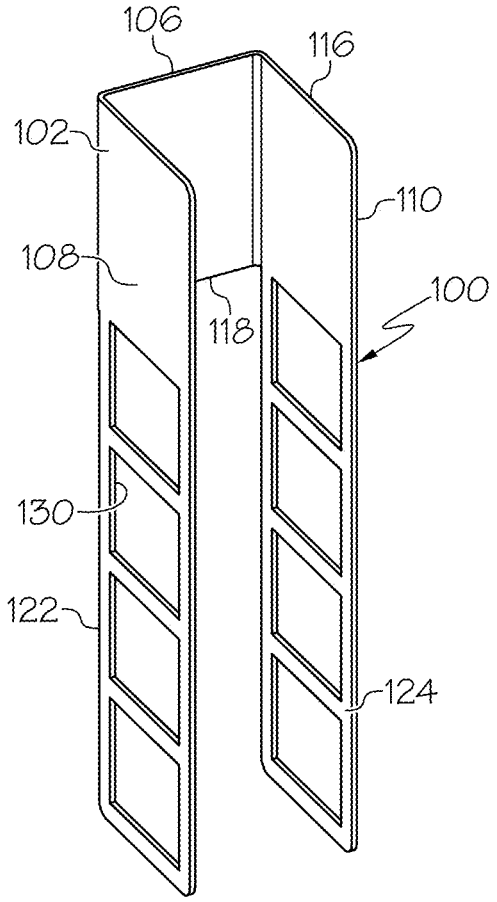
FIG. 4 is a perspective view of the inventive construction tie in a pre-installation form for storage or shipping and prior to bending of the flanges into the lateral or perpendicular position.
Figure 5:
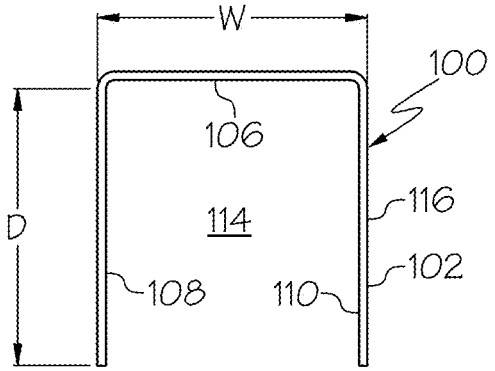
FIG. 5 is a plan view of the construction tie shown in FIG. 4.

With continuing reference to FIGS. 2-6, in one embodiment the construction tie 100 of the present invention comprises a clip 102 for engaging with the U-channel 20. The clip 102 is generally U-shaped in cross-section comprising a back section 106 and first and second side sections 108 and 110, respectively. Each of the back section 106 and first and second side sections 108 and 110 defines a vertical plane. In this way, the clip defines a channel receiving space 114 (FIG. 5) for slidably receiving the vertical U-channel 20. The clip 102 has a top edge 116 and a bottom edge 118. The clip102 also has a length "L" (FIGS. 6&7), a width "W" (FIG. 5), and a depth "D" (FIG. 5). As shown in FIG. 2, the depth D of the clip 102 is less than the depth D of the installed façade material 24 (FIGS. 3&2) so that the tie is not visible when the facade material is installed.

The clip member 102 is configured to receive and closely conform to the U-channel 20 so that the first and second sides 34 and 36 of the U-channel abut the first and second side sections 108 and 110 of the clip 102, as best seen in FIGS. 2 and 3. In the drawings, no space is shown between the inside of the walls of the clip 102 and the outside walls of the U-channel 20. It will be understood that, in some cases, there may be a small space between the two structures. As used herein, "closely conform" means that this preferably is less than about one-half inch on any side.

The tie 100 further comprises at least one flange and, in this embodiment, comprises first and second flanges 122 and 124. The first flange 122 extends from the bottom edge 118 of the first side 108 of the clip 102, and the second flange 124 extends from the bottom edge of the second side 110 of the clip.

Figure 6:
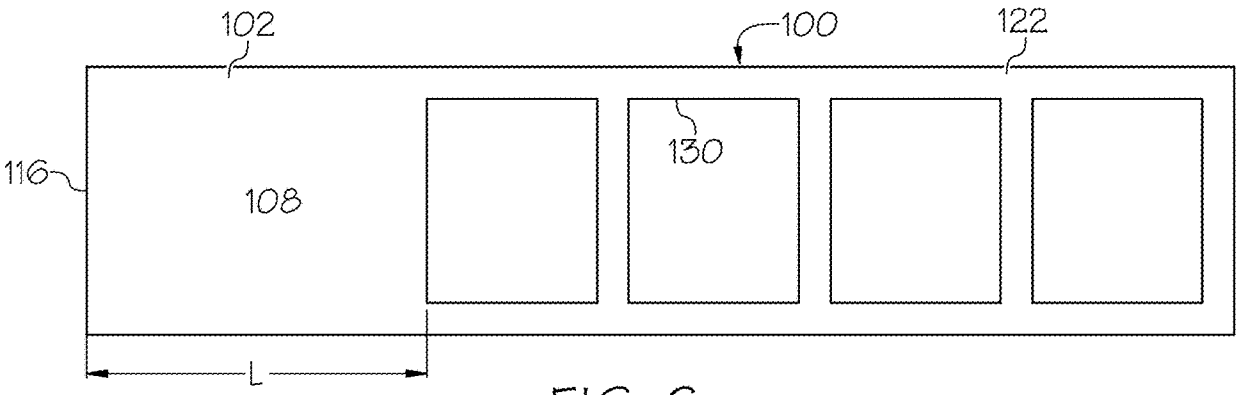
FIG. 6 is a side elevational view of the construction tie shown in FIG. 4.

In some embodiments, the tie 100 is initially formed with the flanges 122 and 124 in a first position, shown in FIGS. 4-6. In this position, each of the flanges 122 and 124 extends downwardly from the bottom edge 118 of one of the clip 102 and defines a plane continuous with the plane of the side section to which it is joined. This configuration may be advantageous for storing, packing, and shipping the ties.

Figure 7:
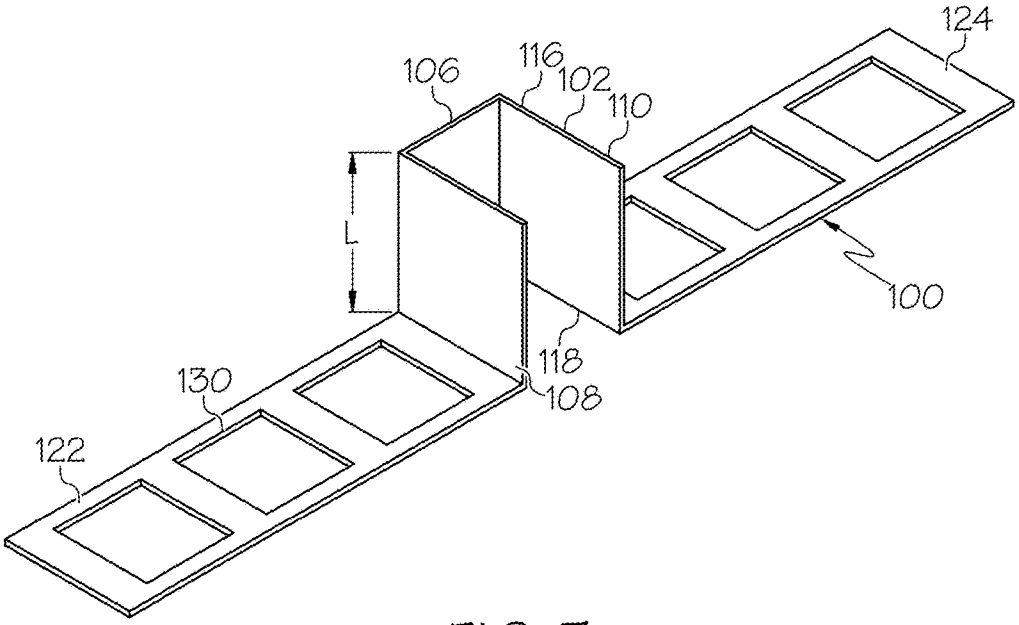
FIG. 7 is a perspective view of the construction tie in the installation position with the flanges extending laterally.

However, each flange 122 and 124 is configured to be bent manually at the point adjacent the bottom edge 118 of the clip 102 into a second position, shown in FIG. 7, in which the flanges extend laterally in a plane that intersects the plane of the side section to which it is joined. In most instances, in the second position, the flanges will be perpendicular (at right angles) to the clip 102. When received at the installation site, the user can decide whether to use one or both of the flanges, and then shape the tie accordingly.

As exemplified herein, both of the flanges of the tie are joined to the clip at the bottom edge. It will be appreciated, that in some embodiments, the flanges may be attached at a location along the length of the clip or at the top edge of the clip. Still further, in other embodiments, the flanges may be joined to the clip at the same vertical position or they may be positioned a distance apart vertically so as to accommodate different façade materials.

In the illustrative embodiment of FIGS. 2-7, the flanges 122 and 124 and the clip 102 are integrally formed. However, in some embodiments not shown herein, the flanges may be connected to the clip by welding, or bolting, or any other suitable means. This attachment may be permanent or removable.

In most embodiments, it is desirable to configure the flanges in a manner that will grip or otherwise engage the mortar when installed. In the embodiments shown herein, the flanges 122 and 124 are provided with one or more cut-outs 130. Other configurations are also suitable. For example, the flanges may include corrugations or ribs.

After the brick or other façade 24 is completed and the mortar has set up, the U-channel 20 may be secured to the clip 102. For example, screws or bolts (not shown) may be drilled through the side sections 34 and 36 of the U-channel into the first and second sides 108 and 110 of the clip 102. Additionally, or alternately, the back 32 of the U-channel 20. may be screwed or bolted to the back section 106 of the clip 102.

Because the tie 100 secures the screen's U-channel 20 to both abutting borders of the brick or other facade material 24, the columns 22 have greater stability. Also, this attachment eliminates the need for costly wood framing inside the column. Still further, with multiple ties spaced vertically along the U-channel 20, the center of the U-channel is prevented from moving radially relative to the center of the column 22.

However, as mentioned, in this embodiment, the tie 100 is configured so that it is hidden when application of the façade material 22 is completed. To locate the hidden ties 100, the present invention may be provided with a way to detect the location of the hidden ties. In this embodiment, and in instances where the U-channel is aluminum or some other non-ferrous material, the ties may comprise a magnetically detectable material. To that end, the ties may be integrally formed from 18-gauge steel sheet metal. In this way, the ties can be located easily using a magnet or stud finder.

Figure 8:
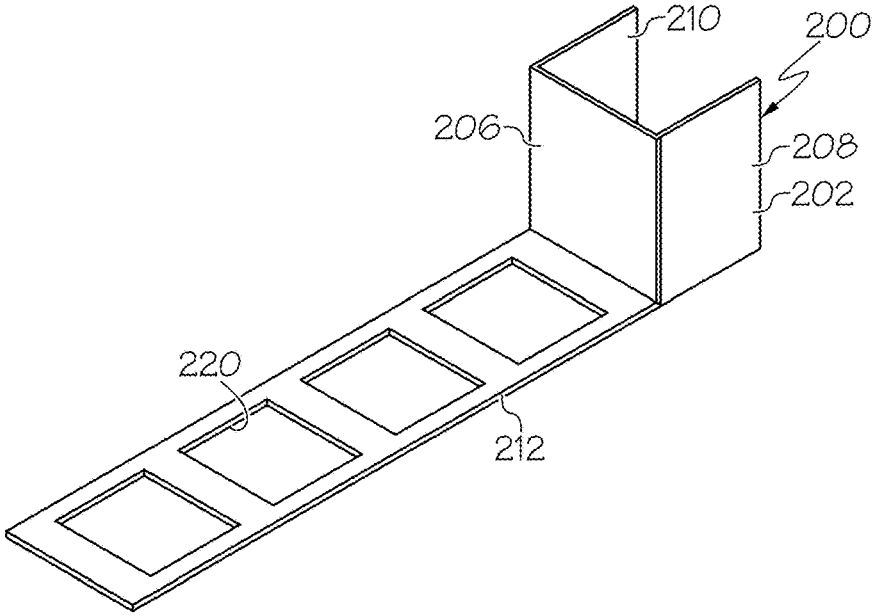
FIG. 8 is a rear perspective view of a second embodiment of the construction tie of the present invention. In this embodiment, there is only one flange extending from the back of the clip member.
Figure 9:
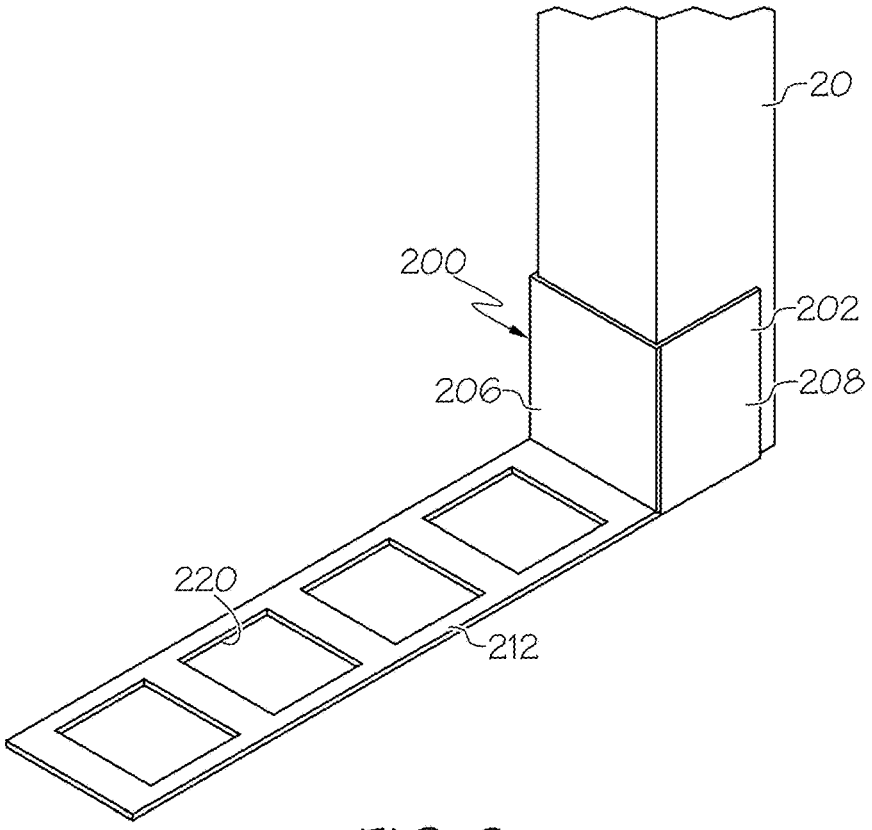
FIG. 9 is a rear perspective view of the construction tie of FIG. 8 shown with the clip positioned on a U-channel.

Turning for a moment to FIGS. 8 and 9, another embodiment of the inventive tie will be described. In this embodiment, the tie 200 comprises a clip 202 that may be configured similarly to the clip 102 of the previous embodiment, that is, it may have a back 206 and first and second sides 208 and 210. This tie 200 includes a single flange 212. The flange 212 may be formed similarly to the flanges 122 and 124 of the previous embodiment, that is, joined to the bottom edge 216 of the clip 202 and having one or more cut-outs 220 to engage the mortar. However, in this embodiment, the flange 212 is joined to the back section 206 of the clip. Alternately, the single flange 212 could extend from either side of the clip 202.

Having described how to make and use the construction tie of the present invention, its use now will be explained with reference to FIGS. 1-3. The U-channels 20 of the screen system 12 are anchored in the structure in a known manner. The application of the façade material 24 then is carried out in a known manner applying the façade units and bonding them with mortar. For example, as illustrated in FIGS. 2 and 3, a first section of façade material 24 comprises several rows of bricks is installed.

If the ties 100 are provided to the site with the flanges in the first or unbent position, as seen in FIG. 4, then one or both flanges 122 and 124 are shaped into the second or laterally extended position, as indicated by the façade material. In some instances, depending on the façade material, only one of the flanges 122 and 124 will be bent into the lateral (second) position; the other flange may remain in the vertical (first) position and extend down along the side of the U-channel.

Next, the shaped construction 100 tie is positioned with the clip 102 on the back 32 of the U-channel 20 and the flanges 122 and 124 laid out over the top of the adjacent brick 24. Mortar then may be applied over the bricks and the flanges 122 and 124. After laying a second section of bricks, another tie 100 is installed. This process is repeated until the installation of the façade material 24 is completed.

After application of the façade material 24, the U-channel 20 may be secured to the tie. In this embodiment, in which the ties are steel, the ties 100 is easily located using a magnet or stud finder because the U-Channel is non-ferrous. Then, the U-channel 20 is screwed or bolted to the clip 102 through the inside of U-channel. Now it will be appreciated that the installed ties 100 form a secure linkage between the U-channel 20 and adjacent façade material.

The inventive ties may be sold separately. Alternately, the ties may be included in a kit for installing the screen system. Still further, the screen system may include the ties for use with the U-channels.

For the purpose of this description, the words left, right, front, back, top, bottom, vertical, horizontal, lateral, medial, inside, and outside may be used to describe the various parts and directions of the invention as depicted in use in FIGS. 2 and 3, that is, when installed in a column or other structure. These descriptive terms should not be considered as limiting the possible orientations of the invention or how it may be used. The terms are merely used to describe the various parts and directions so they may be readily understood and located in the drawings.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A method for installing a retractable screen system in a structure wherein the screen system comprises first and second vertical U-channels that receive side edges of a screen panel, wherein the structure includes façade material that has a depth when installed, wherein the installed façade material comprises a plurality of units joined by mortar, and wherein the each of the first and second U-channels is U-shaped in cross-section comprising a back and first and second sides and defining a vertical screen receiving space therebetween, the method comprising:

anchoring first and second U-channels in the structure, wherein each of the first and second U-channels is sized to receive a side edge of the screen panel, and wherein anchoring the first and second U-channels includes positioning the U-channels relative to each other so that when the screen system is installed in the structure the side edges of the screen panel will be received inside the vertical screen receiving spaces in the U-channels for vertical movement therein;

installing a first section of façade material adjacent the first and second sides of each of the first and second U-channels, the first section of façade material defining a top;

for each of the first and second U-channels, providing a plurality of construction ties each comprising:

a clip that is U-shaped in cross-section comprising a back section and first and second side sections, each of the back section and first and second side sections defining a vertical plane, the clip defining a channel receiving space for slidably receiving the vertical U-channel, wherein the clip has a top edge and a bottom edge, wherein the clip has a length, a width, and a depth, and wherein the depth of the clip is less than the depth of the installed façade material so that the tie is not visible when the facade material is installed; and at least one flange joined to the bottom edge of one of the back section, the first side section, and the second side section of the clip, wherein the at least one flange is configured to be bent at the point adjacent the bottom edge of the clip from a first position in which the at least one flange extends downwardly from the bottom edge of the clip and defines a plane continuous with the plane of the back section, the first side section, or the second side section of the clip member from which the at least one flange extends to a second position in which the at least one flange extends laterally in a plane that intersects the plane of the back section, the first side section, or the second side section of the clip from which the at least one flange extends;

for each of the first and second U-channels, shaping a first construction tie by bending the at least one flange into the second position;

for each of the first and second U-channels, positioning the shaped first construction tie on the U-channel so that the at least one flange overlies the top of the first section of façade material and so that the back and first and second sides of the clip are adjacent the back and first and second sides, respectively, of the U-channel;

for each of the first and second U-channels, applying mortar over the at least one flange and the top of the first section of façade material;

for each of the first and second U-channels, installing a second section of façade material over the first section of façade material and around the anchored U-channel adjacent the first and second sides of the U-channel and over the at least one flange of the first construction tie; and for each of the first and second U-channels, repeating the steps of installing the sections of façade material and positioning the shaped construction ties therebetween until the installation of the first and second U-channels is complete.

2. The method of claim 1 wherein the at least one flange is configured to engage the mortar.

3. The method of claim 2 wherein the at least one flange is formed with cut-outs to receive the mortar.

4. The-method of claim 1 wherein the clip and the at least one flange is integrally formed.

5. The method of claim 1 wherein the at least one flange comprises a single flange.

6. The method of claim 5 wherein the single flange is joined to the bottom edge of the back section of the clip.

7. The method of claim 1 wherein the U-channel is formed of nonferrous material and wherein the construction ties comprise magnetically detectable material and further comprising:

magnetically detecting each of the installed construction ties; and for each of the plurality of installed construction ties, securing the U-channel to the clip through the screen receiving space of the U-channel.

8. The method of claim 7 wherein the tie comprises steel.

9. The method of claim 7 wherein the step of shaping the first construction tie includes only bending the first flange into the second position.

10. The method of claim 1 wherein the at least one flange comprises a first flange extending from the bottom edge of the first side section of the clip and a second flange extending from the bottom edge of the second side section of the clip, and wherein the step of shaping the first construction tie includes bending the first flange into the second position.

11. The method of claim 1 wherein the at least one flange comprises a first flange extending from the bottom edge of the first side of the clip and a second flange extending from the bottom edge of the second side of the clip, and wherein the step of shaping the first construction tie includes bending the first and second flanges into the second position.

12. The method of claim 1 further comprising:

for each of the plurality of installed construction ties securing the U-channel to the clip through the vertical screen receiving space of the U-channel.

13. A method for installing in a structure the vertical U-channels of a retractable screen system using a plurality of construction ties wherein the screen system comprises vertical U-channels that receive side edges of a screen panel, wherein the façade material of the structure has a depth when installed, wherein the installed façade material comprises a plurality of units joined by mortar, and wherein the U-channels are U-shaped in cross-section comprising a back and first and second sides and defining a vertical screen receiving space therebetween, the method comprising:

anchoring first and second U-channels in the structure, wherein each of the first and second U-channels is sized to receive a side edge of the screen panel, and wherein anchoring the first and second U-channels includes positioning the U-channels relative to each other so that when the screen system is installed in the structure the side edges of the screen panel are received inside the vertical screen receiving spaces in the U-channels for vertical movement therein;

installing a first section of façade material adjacent the first and second sides of the anchored U-channel, the first section of façade material defining a top;

providing a plurality of construction ties each comprising:

a clip that is U-shaped in cross-section comprising a back section and first and second side sections, each of the back section and first and second side sections defining a vertical plane, the clip defining a channel receiving space for slidably receiving the vertical U-channel, wherein the clip has a top edge and a bottom edge, wherein the clip has a length, a width, and a depth, and wherein the depth of the clip is less than the depth of the installed façade material so that the tie is not visible when the facade material is installed; and at least one flange joined to the bottom edge of one of the back section, the first side section, and the second side section of the clip, wherein the at least one flange defines a plane perpendicular to the plane of the back section, the first side section, or the second side section of the clip from which the at least one flange extends;

positioning the first construction tie on the U-channel so that the at least one flange overlies the top of the first section of façade material and so that the back and first and second sides of the clip are adjacent the back and first and second sides, respectively, of the U-channel;

applying mortar over the at least one flange and the top of the first section of façade material;

installing a second section of façade material on top of the first section of façade material and around the anchored U-channel adjacent the first and second sides of the U-channel and over the at least one flange of the first construction tie; and repeating the steps of installing the sections of façade material and positioning the shaped construction ties therebetween until the installation of the U-channel is complete.

14. The method of claim 13 wherein the at least one flange is configured to engage the mortar.

15. The method of claim 14 wherein the at least one flange is formed with cut-outs to receive the mortar.

16. The method of claim 13 wherein the clip and the at least one flange is integrally formed.

17. The method of claim 13 wherein the at least one flange comprises a single flange.

18. The method of claim 17 wherein the single flange is joined to the bottom edge of the back section of the clip.

19. The method of claim 13 wherein the U-channel is formed of nonferrous material and wherein the construction ties comprise magnetically detectable material and further comprising:

magnetically detecting each of the installed construction ties; and for each of the plurality of installed construction ties securing the U-channel to the clip through the screen receiving space of the U-channel.

20. The method of claim 19 wherein the tie comprises steel.

21. The method of claim 13 wherein the at least one flange comprises a first flange extending from the bottom edge of the first side of the clip and a second flange extending from the bottom edge of the second side of the clip.

22. The method of claim 13 further comprising:

for each of the plurality of installed construction ties securing the U-channel to the clip through the-vertical screen receiving space of the U-channel.

* * * * *